United States Patent [19]

Dodson

[11] Patent Number: 4,909,811

[45] Date of Patent: Mar. 20, 1990

[54] PROCESS ON OR WITH LIQUID

[75] Inventor: Christopher E. Dodson, Reading, England

[73] Assignee: Torftech Limited, United Kingdom

[21] Appl. No.: 178,363

[22] Filed: Apr. 6, 1988

[30] Foreign Application Priority Data

Apr. 10, 1987 [GB] United Kingdom ..... 8708667

[51] Int. Cl.[4] ..... B01D 47/02

[52] U.S. Cl. ..... 55/92; 55/260; 261/79.2

[58] Field of Search ..... 55/90–92, 55/260; 261/79.2

[56] References Cited

U.S. PATENT DOCUMENTS

| | | | |
|---|---|---|---|
| Re. 28,616 | 11/1975 | Yankura | 55/92 |
| 2,813,011 | 11/1957 | Weber . | |
| 2,847,083 | 8/1958 | Hibshman | 261/79.2 |
| 3,526,082 | 9/1970 | Thuillier | 261/79.2 X |
| 3,989,485 | 11/1976 | Kilian | 55/92 X |
| 4,065,527 | 12/1977 | Graber | 55/92 X |
| 4,098,582 | 7/1978 | Takeda | 55/92 X |
| 4,297,111 | 10/1981 | Ross | 55/92 |
| 4,337,315 | 6/1982 | Fukushima et al. | 261/79.2 X |
| 4,349,360 | 9/1982 | Schuurmans et al. | 261/79.2 X |
| 4,424,069 | 1/1984 | Chang | 261/79.2 X |
| 4,618,350 | 10/1986 | Rowe et al. | 55/92 |

FOREIGN PATENT DOCUMENTS

| | | |
|---|---|---|
| 68853 | 3/1987 | European Pat. Off. . |
| 1074862 | 10/1954 | France . |
| 338108 | 11/1930 | United Kingdom . |
| 708355 | 10/1951 | United Kingdom . |
| 719669 | 12/1954 | United Kingdom . |
| 825841 | 12/1959 | United Kingdom . |
| 1084286 | 9/1967 | United Kingdom . |
| 1183355 | 4/1970 | United Kingdom . |
| 1455149 | 11/1976 | United Kingdom . |

*Primary Examiner*—Robert Spitzer

*Attorney, Agent, or Firm*—Watson, Cole, Grindle & Watson

[57] ABSTRACT

A method of carrying out a process on or with liquid comprises moving a bed of the liquid in a band 28 continuously along an annular path defined in a chamber 12 by passing fluid 38 having both circumferential and vertical components through the bed along the path during the carrying out of the process.

20 Claims, 1 Drawing Sheet

PROCESS ON OR WITH LIQUID

Figure 1:
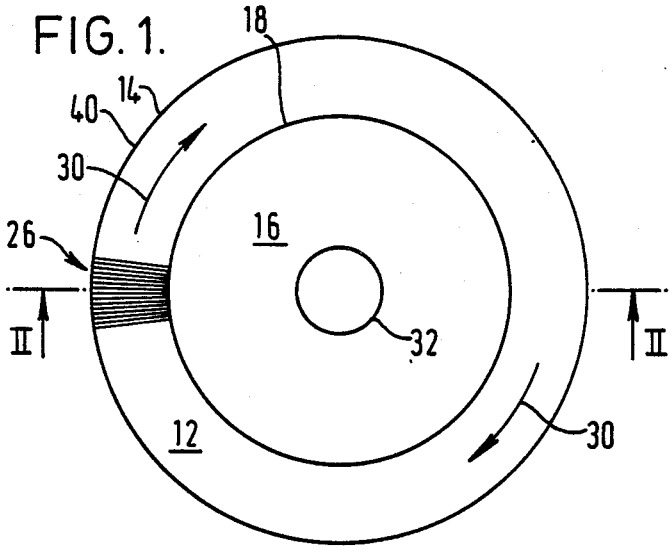

This invention relates to a method of carrying out a process on or with liquid.

In European Publication No. 68853 there is disclosed apparatus for moving a bed of particulate material in a band continuously along an annular path by passing fluid having both circumferential and vertical components through the bed along its path. I have surprisingly discovered that it is possible to move a bed of liquid in the same way and the present invention provides a method of carrying out a process on or with liquid, comprising moving a bed of the liquid in a band continuously along an annular path by passing fluid having both circumferential and vertical components through the bed along the path during the carrying out of the process.

Preferably the method includes feeding the bed with the liquid as the bed is moved along the path, and removing the resulting product of the process from the moving bed.

The fluid which is passed through the bed may comprise gaseous matter. This gaseous matter may treat, be treated by, or react with, the liquid as it passes through the bed. Thus, for example, the process may comprise heating the liquid by the passage therethrough of hot gaseous matter.

The gaseous matter may have solid particulate matter, a vapor or a mist entrained therewith. In this case the solid particulate matter, vapor or mist may treat, be treated by, mix with, or react with, the liquid during passage through the bed with the gaseous matter. Thus, for example, the process may comprise mixing finely divided solid particulate matter into a liquid. Also, for example, the process may comprise distillation of the liquid by passing hot vapour through it.

The fluid which is passed through the bed may comprise liquid matter. This liquid matter may treat, be treated by, mix with, or react with, the liquid in the bed during passage through the bed. This liquid matter may have solid particulate material entrained therewith in which case the solid particulate material may treat, be treated by, mix with or react with, the liquid in the bed during passage through the bed with the liquid matter.

The fluid may be provided with its circumferential and vertical components by being passed between an annular array of inclined vanes beneath the annular path along which the bed is moved.

The liquid on or with which the process is carried out may have particulate material mixed therewith.

The liquid on or with which the process is carried out may contain micro-organisms. Thus, for example, the process may comprise fermentation.

The liquid on or with which the process is carried out may comprise liquid droplets.

Particulate material may be moved with the liquid in the band along the annular path, in which case the particulate material may be treated by the liquid in the bed as it moves therewith along the annular path. Such a method is particularly applicable to treating particulate material by coating it with liquid. For example, for coating particulate foodstuffs.

The fluid which is passed through the bed may comprise a first fluid which is passed through the bed along a first portion of the annular path to treat the liquid in the bed as it is moved along the first portion and a second fluid which is passed through the bed along a second portion of the bed to be treated by the liquid which has been treated during its passage through the first portion. Such a method is particularly applicable to cooling gases, in which case the liquid is cooled by the first fluid and the second fluid, which is the fluid requiring cooling, is cooled by the thus cooled liquid.

The invention also extends to a product of methods as aforementioned.

Figure 2:
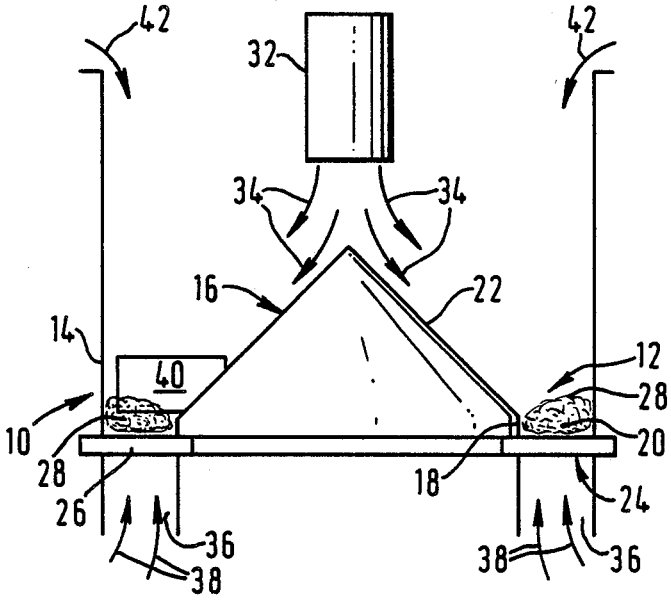

In order that the invention may be well understood, an embodiment thereof, which is given by way of example only, will now be described with reference to the accompanying drawing, in which:

FIG. 1 is a top plan view of an apparatus for a method embodying the present invention; and FIG. 2 is an axial cross-section view of the same apparatus taken along the line II—II of FIG. 1.

The apparatus 10 shown in the drawing includes a chamber 12 which is bounded externally by a tubular wall 14. In the illustrated apparatus, the chamber 12 is annular, being bounded internally by a central structure 16 of the apparatus. The central structure 16 comprises a tubular wall portion 18 adjacent the annular base 20 of the chamber 12 and a conical wall portion 22 extending from the wall portion 18. The base 20 of the chamber is provided with an annular fluid inlet 24 which is spanned by an annular array of inclined vanes 26. For simplicity, only a portion of the array of vanes is illustrated in FIG. 1. However it is to be understood that the array extends completely around the inlet 24. The vanes 26, which in the embodiment are field and arranged in overlapping relationship, are inclined in order to impart vertical and circumferential components to flow of fluid through the inlet 24 to move a bed of liquid in the chamber 12, indicated at 28 in FIG. 2, in a compact band continuously along an annular path in the chamber 12 as the fluid passes through the liquid in the bed. In the embodiment, the vanes are arranged so that the bed of liquid moves along the annular path in the sense indicated by arrows 30 in FIG. 1.

The liquid for the bed is introduced into the chamber 12 in the illustrated apparatus through an inlet 32 disposed above the central structure 16 so as to be guided by the conical wall 22 thereof as indicated by arrows 34 in FIG. 2 towards the base 20 of the chamber 12. The fluid which is passed through the bed of liquid to move the bed continuously along the annular path in the chamber is directed to the inlet 24 through an annular passage 36 beneath the inlet as indicated by arrows 38 in FIG. 2.

As the bed of liquid is moved continuously along the annular path by the passage of fluid through the bed a process is carried out on or with the liquid. The resulting product of this process is removed from the bed via an outlet. In the illustrated apparatus this outlet is shown as a closable opening 40 in the wall 14 of the apparatus.

A simple example of a process using the above apparatus is a gas/liquid reaction. In this case, the liquid is introduced into the chamber 12 through the inlet 32 and the gas which is to react with the liquid forms the fluid which is passed through the bed of liquid to move the bed along the annular path in the chamber. an completion of the reaction, the opening 40 is opened to enable the products of the reaction to discharge from the apparatus.

The liquid for the bed may be introduced into the chamber 22 by means other than the inlet 32 illustrated. For example, the liquid could be introduced into the chamber through an inlet disposed around and above the outer periphery of the chamber, as indicated by arrows 42 in FIG. 2; through inlets adjacent the base of the chamber through the wall 14 or the wall portion 18; through an inlet provided in the conical wall portion 22; or through nozzles provided in the blades 26. The outlet for the resulting product of a process carried out in the apparatus may be formed other than as a closable opening in the wall 14 as illustrated. For example, the outlet may comprise a closable opening in the central structure 16; a weir provided in the wall 14 or the central structure 16; or, where the products of the process naturally flow upwardly from the bed, an opening above the bed, for example the annular opening between the wall 14 and the inlet 32 in the illustrated apparatus.

In general, the liquid for the bed may additionally contain particulate material mixed therewith, either prior to introduction into the chamber or subsequently. Further, the liquid for the bed may contain microorganisms, which also may be present in the liquid prior to its introduction into the chamber 12 or added to the liquid subsequently. The liquid may also comprise liquid droplets.

Also, in general the fluid which is passed through the bed of liquid to move the bed continuously along the annular path in the chamber may comprise gaseous matter which may additionally have solid particulate matter, a vapour or a mist entrained therewith or liquid matter which may additionally entrain solid particulate material.

It is to be understood that the liquid which is moved along the annular path in the chamber may itself be processed in the apparatus or a process may be carried out in the apparatus with the liquid.

In addition to the above gas/liquid reaction process, the following are examples of other processes which may also be carried out during the movement of a bed of liquid in a band continuously along an annular path by the passage of fluid having both circumferential and vertical components through the bed along the path:

A. the mixing, reacting or blending of liquids, one of which may be used as the fluid which is passed through the bed, and the or each of which may contain solid particulate material suspended or dissolved therein;

B. coating particulate material with liquid matter, in which case the particulate material may be added to the liquid in the bed separately therefrom so as to move with the liquid along the annular path of the bed;

C. fermentation of liquid containing microorganisms;

D. distillation or cracking of liquids, in which case the fluid which is passed through the bed of liquid to be distilled or cracked may comprise hot gaseous matter or contain hot vapour;

E. heating or cooling liquid by the passage of hot or cold gaseous matter through the liquid in the bed;

F. humidification or de-humidification of gaseous matter which is passed through the liquid bed;

G. the cleaning of gaseous matter as it is passed through the bed, for example by chemical reaction with the liquid in the bed; and H. the heating or cooling of gaseous matter as it is passed through the liquid bed.

In connection with the latter process the liquid in the bed may be heated or cooled by the passage through the bed along a first portion of the annular path of a hot or cold gas and the gaseous matter to be heated or cooled passed through the bed along a second portion of the bed to be heated or cooled by the liquid which has been heated or cooled during its passage through the first portion.

I claim:

1. A method of carrying out a process on or with a liquid comprising the steps of (1) introducing the liquid into a chamber bounded by a vertically disposed tubular wall above a horizontal annular fluid inlet to the chamber, and the (2) passing fluid upwardly through an annular array of inclined vanes spanning said annular fluid inlet such that the fluid supports a bed of the liquid above the vanes and moves the bed in a compact band continuously circulating along an annular path above the vanes as the fluid passes through the bed with circumferential and vertical flow components.

2. A method as claimed in claim 1, comprising feeding the bed with the liquid as the bed is moved along said path, and removing the resulting product of said process from the moving bed.

3. A method as claimed in claim 1, wherein said fluid which is passed through the bed comprises gaseous matter.

4. A method as claimed in claim 3, wherein the gaseous matter treats, is treated by, or reacts with, the liquid as it passes through the bed.

5. A method as claimed in claim 3, wherein the gaseous matter has solid particulate matter entrained therewith.

6. A method as claimed in claim 5, wherein the solid particulate matter treats, is treated by, mixed with, or reacts with, the liquid during passage through the bed with the gaseous matter.

7. A method as claimed in claim 3, wherein the gaseous matter has a vapour or a mist entrained therewith.

8. A method as claimed in claim 7, wherein the vapour or mist treats, is treated by, mixes with, or reacts with, the liquid during passage through the bed with the gaseous matter.

9. A method as claimed in claim 1, wherein the fluid which is passed through the bed comprises liquid matter.

10. A method as claimed in claim 9, wherein the liquid matter treats, is treated by, mixes with, or reacts with, the liquid in the bed during passage through the bed.

11. A method as claimed in claim 9, wherein the liquid matter has solid particulate material entrained therewith.

12. A method as claimed in claim 11, wherein the solid particulate material treats, is treated by, mixes with, or reacts with, the liquid in the bed during passage through the bed with the liquid matter.

13. A method as claimed in claim 1 ,wherein the liquid on or with which the process is carried out has particulate material mixed therewith.

14. A method as claimed in claim 1, wherein the liquid on or with which the process is carried out contains micro-organisms.

15. A method as claimed in claim 1, wherein the liquid on or with which the process is carried out comprises liquid droplets.

16. A method as claimed in claim 1, wherein particulate matter is moved with the liquid in said band along said annular path.

17. A method as claimed in claim 16, wherein the particulate matter is treated by the liquid as it moves therewith along said annular path.

18. A method as claimed in claim 1, wherein said fluid which is passed through said bed comprises a first fluid which is passed through said bed along a first portion of said annular path to treat the liquid in the bed as it is moved along said first portion and a second fluid which is passed through said bed along a second portion of the bed to be treated by the liquid which has been treated during its passage through said first portion.

19. A method as claimed in claim 18, wherein said liquid is cooled by said first fluid, and the said second fluid is cooled by the thus cooled liquid.

20. A product of a method as claimed in claim 1.

* * * * *

UNITED STATES PATENT AND TRADEMARK OFFICE

CERTIFICATE OF CORRECTION

PATENT NO. : 4,909,811

DATED : March 20, 1990

INVENTOR(S) : Christopher E. Dodson

It is certified that error appears in the above-identified patent and that said Letters Patent is hereby corrected as shown below:

On the title page:

Item [21] Appln. No. [178,363] should read --178,369

Signed and Sealed this

Twenty-sixth Day of March, 1991

*Attest:*

HARRY F. MANBECK, JR.

*Attesting Officer*

*Commissioner of Patents and Trademarks*